US006091185A

United States Patent [19]

Matsubara et al.

[11] Patent Number: 6,091,185

[45] Date of Patent: Jul. 18, 2000

[54] LATERAL ELECTRODE TYPE SPARK PLUG WITH GEOMETRICAL RELATIONSHIPS WITH GROUND ELECTRODE

[75] Inventors: Yoshihiro Matsubara, Mie-ken; Akio Kokubu; Kazumasa Yoshida, both of Nagoya, all of Japan

[73] Assignee: NGK Spark Plug Co., Ltd., Aichi-ken, Japan

[21] Appl. No.: 09/058,781

[22] Filed: Apr. 13, 1998

[30] Foreign Application Priority Data

Apr. 15, 1997 [JP] Japan ..... 9-096825

[51] Int. Cl.[7] ..... H01T 13/20

[52] U.S. Cl. ..... 313/138; 313/118; 313/141; 313/142

[58] Field of Search ..... 313/130, 131 R, 313/132, 138, 141, 142, 118

[56] References Cited

U.S. PATENT DOCUMENTS

| | | | |
|---|---|---|---|
| 3,870,918 | 3/1975 | Senda et al. | 313/131 R |
| 5,109,178 | 4/1992 | Yoshida et al. | 313/137 |
| 5,128,583 | 7/1992 | Ma | 313/137 |
| 5,448,130 | 9/1995 | Matsutani et al. | 313/141 |
| 5,731,654 | 3/1998 | Benedikt et al. | 313/131 A |

FOREIGN PATENT DOCUMENTS

| | | | |
|---|---|---|---|
| 0 390 065 | 10/1990 | European Pat. Off. | H01T 13/38 |
| 0 774 812 | 5/1997 | European Pat. Off. | H01T 13/14 |
| 43 31 269 | 3/1995 | Germany | H01T 21/02 |
| 6-310253 | 11/1994 | Japan | H01T 13/20 |

*Primary Examiner*—Nimeshkumar D. Patel
*Assistant Examiner*—Matthew J. Gerike
*Attorney, Agent, or Firm*—Sughrue, Mion, Zinn, Macpeak & Seas, PLLC

[57] ABSTRACT

In a spark plug, a cylindrical metal shell (1) is provided whose inner wall has a rear section and a front section to respectively serve as a diameter-increased section and a diameter-decreased section with a seat portion (1) as a boundary therebetween. An insulator (2) is fixedly placed within the metal shell (1) so that a front end surface (21) of the insulator (2) extends beyond a front end surface (12) of the metal shell (1) with a shoulder portion (231) of an insulator nose (23) engaged against the seat portion (11) of the metal shell (1) by way of a packing (10). A center electrode (3) is fixedly placed within an axial bore (22) of the insulator (2), A ground electrode (4) is connected to the front end surface (12) of the metal shell (1), and bent so that a front end surface (41) of the ground electrode (4) opposes an outer surface (311) of the center electrode (3). The outer surface (311) and a front end surface (31) of the center electrode (3) are provided to respectively serve as a firing portion so as to form a spark discharge gap (Go) with the front end surface (41) of the ground electrode (4), the front end surface (41) of the ground electrode (4) forming an air gap (G) with an outer surface (25) of the insulator (2) so as to release creeping spark discharges along a front end surface (21) of the insulator (2).

10 Claims, 17 Drawing Sheets

LATERAL ELECTRODE TYPE SPARK PLUG WITH GEOMETRICAL RELATIONSHIPS WITH GROUND ELECTRODE

BACKGROUND OF THE INVENTION

1. Field of the Invention

The invention relates to a spark plug mounted on an internal combustion engine, and particularly concerns to a spark plug which is improved to facilitate the self-cleaning action against the carbon-related deposit collected on an insulator.

2. Description of Prior Art

In a semi-creeping discharge type spark plug disclosed by e.g., U.S. Pat. No. 5,448,130, an air gap is formed between an outer surface of a center electrode and a front end surface of a ground electrode, and releasing creeping spark discharges along a front end surface of an insulator so as to facilitate the self-cleaning action.

As an extension technique of the above spark plug, an intermittent creeping discharge type spark plug has been introduced in which a spark discharge gap is formed between an outer surface of the center electrode, and creeping spark discharges are released from an inner edge portion of a ground electrtode toward a front end surface of an insulator so as to facilitate the self-cleaning action when the insulator is carbon fouled.

However, the insulator nose is likely to be carbon fouled especially when running the engine at the time of traffic congestion in winter seasons. This often leaks a high voltage through the carbon deposit so as to induce a flashover phenomenon in which the spark discharges tend to irregularly jump deep behind an open-ended metal shell.

The flashover phenomenon prevents the spark discharges from normally running across electrodes, thus inviting inconveniences such as, for example, an engine stall, unstable idling, loss of cold starting capability and insufficient accelaration of the engine. In order to remedy these inconveniences, it has been desired to introduce effective countermeasures against the flashover.

As if to make the situation get worse, a ledge portion is provided at an inner wall of the metal shell to project inward so as to rest an insulator thereon by way of a shoulder portion. The presence of the ledge portion diminishes a distance between the ledge portion and an outer surface of the insulator, so as to intensify an electrostatic field around an edge of the ledge portion so as to induce the flashover toward the ledge portion when insulator is carbon fouled unacceptably.

In order to increase the distance between the ledge portion and the outer surface of the insulator, it is supposed to diametrically thin the insulator. This, however,increases a front open area of the metal shell to often invite an entry of carbon (soot) therethrough so as to deteriorate a fouling resistant property.

Therefore, it is a first object of the invention to provide a semi-creeping discharge type spark plug which is capable of effectively protecting the ledge portion against the flashover even when the insulator nose is unacceptably carbon fouled, and further maintaining a high insulation resistance by facilitaing the self-cleaning action due to the creeping spark discharges.

It is a second object of the invention to provide an intermittent creeping discharge type spark plug which is capable of effectively protecting the ledge portion against the flashover even when the insulator nose is carbon fouled considerably, and further insuring a high insulation resistance by facilitaing the self-cleaning action due to intermittent creeping spark discharges.

SUMMARY OF THE INVENTION

According to the present invention, there is provided a semi-creeping discharge type spark plug having a cylindrical metal shell, an inner wall of which has a rear section and a front section to respectively serve as a diameter-increased section and a diameter-decreased section with a seat portion as a boundary therebetween. An insulator is fixedly placed within the metal shell so that a front end surface of the insulator extends beyond a front end surface of the metal shell with a shoulder portion of an insulator nose engaged against the seat portion of the metal shell by way of a packing.

With the seat portion provided without continuously forming a ledge portion, the front section of the inner wall is diametrically smaller than the rear section of the inner wall of the metal shell. This makes it possible to decrease a front open area of the metal shell so as to mitigate an entry of carbon therethrough, and making it also possible to prevent the flashover from penetrating deep behind the front open end of the metal shell, as opposed to the case in which the ledge portion is provided.

With the flashover thus prevented, it is possible to fully utilize the creeping spark discharges to the self-cleaning action so as to maintain a high insulation resistance value. This substantially obviates the inconveniences such as an engine stall, unstable idling, incapability of cold starting and insufficient accelaration of the engine.

According to another aspect of the invention, there is provided a semi-creeping discharge type spark plug which has an insulator fixedly placed within the metal shell so that a front end surface of the insulator extends beyond a front end surface of the metal shell with a shoulder portion of an insulator nose engaged against the seat portion of the metal shell by way of a packing. The insulator is formed so that a diametrical difference is to be 0.5 mm or less between a basal portion of the insulator nose and a forward end of the insulator nose, the latter of which corresponds to the front end surface of the metal shell.

Such is the diametrical difference as to decrease a front open area of the metal shell to avoid an entry of carbon deposit therethrough. It is also possible to increase the distance (insulation space) between the basal portion of the insulator nose and the inner wall of the metal shell so as to prevent the flashover from penetrating behind the front open end of the metal shell.

With the flashover thus thwarted, it is possible to fully utilize the creeping spark discharges to the self-cleaning action so as to maintain a high insulation resistance value. This substantially eliminates the inconveniences such as, for example, an engine stall, unstable idling, incapability of cold starting and insufficient acceleration of the engine.

According to still another aspect of the invention, an inner wall of a metal shell has a ledge portion provided to project inward along the diametrical direction, and creeping spark discharges are usually released toward a front end surface of an insulator in a semi-creeping discharge type spark plug, or the creeping spark discharges are released from a front edge of a ground electrode toward the front end surface of the insulator in an intermittent creeping discharge type spark plug only when an insulator nose is carbon fouled unacceptably. A ledge length of the ledge portion measures 3.0 mm or more. This insures a sufficient clearance between an edge of the ledge portion and the basal portion of the insulator nose so as to effectively thwart the flashover even under the presence of the ledge portion when the insulator nose is carbon foulded.

With the flashover thus effectively thwarted, it is possible to fully utilize the creeping spark discharges or intermittent creeping spark discharges to the self-cleaning action so as to maintain a high insulation resistance value. This substantially eliminates the above inconveniences.

According to yet another aspect of the invention, a geometrical relationship among A, B, and G is defined as $\{(A-B)/2\} \geqq (G+0.1)$. Where A is a diameter of said basal portion of the insulator nose, B is an inner diameter a front portion of the metal shell, and G is the air gap between the front end surface of the ground electrode and the outer surface of the insulator.

Such is the geometrical relationship as to insure a sufficient clearance (insulation space) between the basal portion of the insulator nose and an inner wall of the metal shell compared to the air gap (G) across the ground electrode and the outer surface of the insulator. This makes it possible to satisfactorily block the flashover from penetrating behind a front open end of the metal shell.

With the flashover thus effectively blocked, it is possible to fully utilize the creeping spark discharges or intermittent creeping spark discharges to the self-cleaning action so as to maintain a high insulation resistance value.

DETAILED DESCRIPTION OF THE PREFERRED EMBODIMENTS OF THE INVENTION

Figure 1:
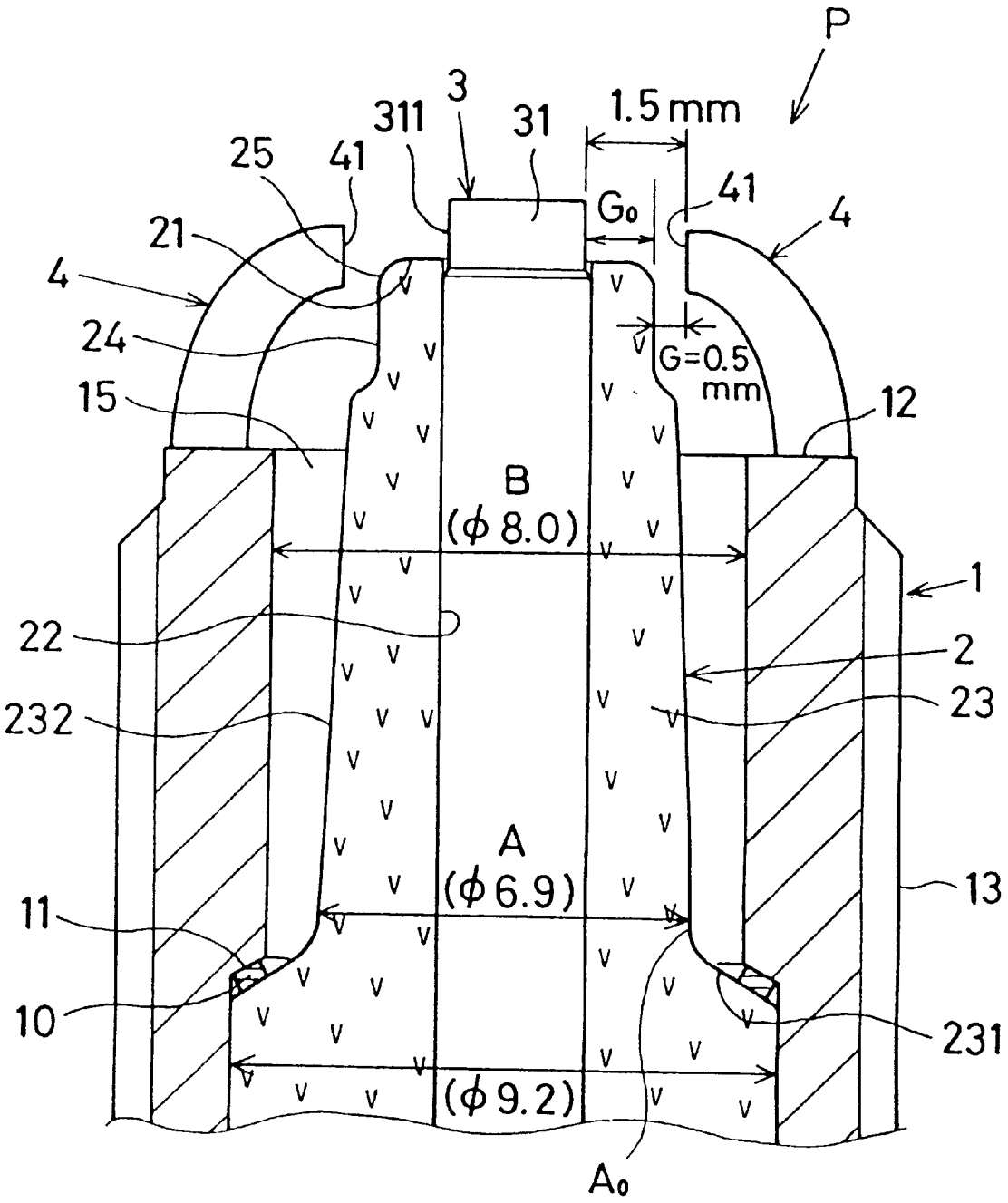
FIG. 1 is a longitudinal cross sectional view of a front portion of a semi-creeping discharge type spark plug (P) according to a first embodiment of the invention.
Figure 2:
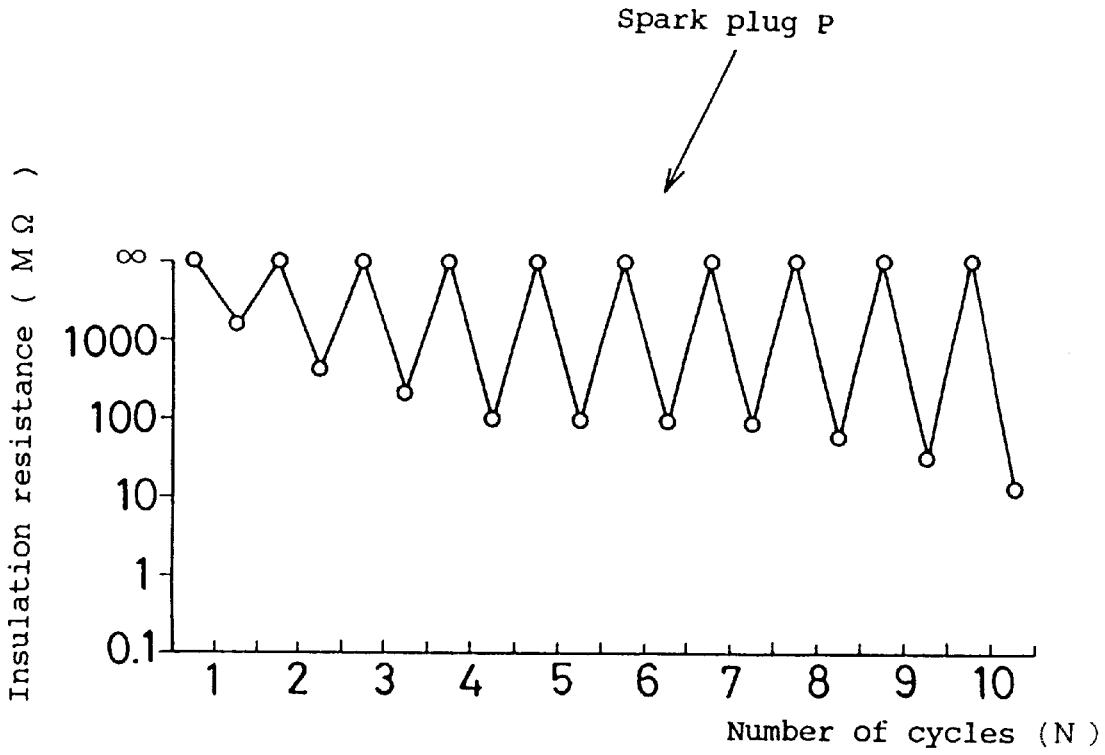
FIG. 2 is a graphical representation showing a relationship between an insulation resistance and the number of cycles in accordance with the semi-creeping discharge type spark plug (P)
Figure 17:
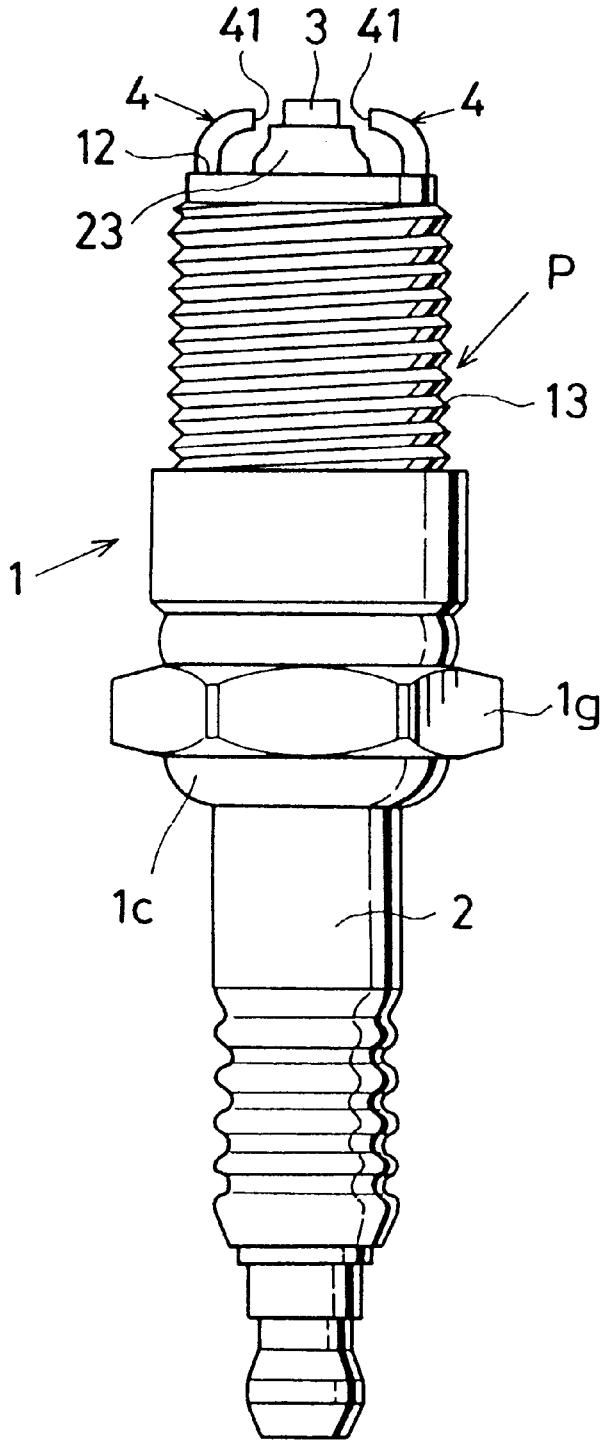
FIG. 17 is a plan view of the semi-creeping discharge type spark plug (P) according to the first embodiment of the invention.

Referring to FIGS. 1, 2 and 17 which show a semi-creeping discharge type spark plug (P) according to a first embodiment of the invention, the spark plug (P) has a cylindrical metal shell 1, an inner wall of which has a seat portion 11. Within the metal shell 1, a tubular insulator 2 is fixedly placed with a front end surface 21 of the insulator 2 extended beyond a front end surface 12 of the metal shell 1. The insulator 2 has an axial bore 22 in which a center electrode 3 is firmly supported. As designated by numeral 4, ground electrodes are welded to the front end 12 of the metal shell 1. A front end surface 41 of the ground electrodes 4 are bent to oppose an outer surface 311 of the center electrode 3 directly or by way of a front end section of the insulator 2.

An outer surface of the metal shell (low carbon steel) 1 has a male threaded portion (M14) 13 through which the spark plug (P) is to be mounted on a cylinder head of an internal combustion engine. An inner wall of the metal shell 1 has a diameter-decreased section (8.0 mm in diameter (B)) provided at a front area forward from the seat portion 11 which is diametrically smaller than a diameter-increased section (9.2 mm in diameter) provided at a rear area backward from the seat portion 11.

The insulator 2 is made of ceramic material with alumina as a main ingredient. The insulator 2 includes an insulator nose 23 having a basal portion (Ao), and measures 6.9 mm in diameter (A) and 14.0 mm in length. In order to fixedly support the insulator 2 within the metal shell 1, the insulator nose 23 forms a shoulder portion 231 which firmly rests on the seat portion 11 by caulking a rear tail 1*c* of a hex portion 1*g* of the metal shell 1. In order to improve the self-cleaning action and readily make an air gap (G), a front end portion of the insulator nose 23 has a straight neck portion 24 which is diametrically constricted to measure 3.6~4.5 mm in diameter and 1.0~2.0 mm in length.

Figure 16:
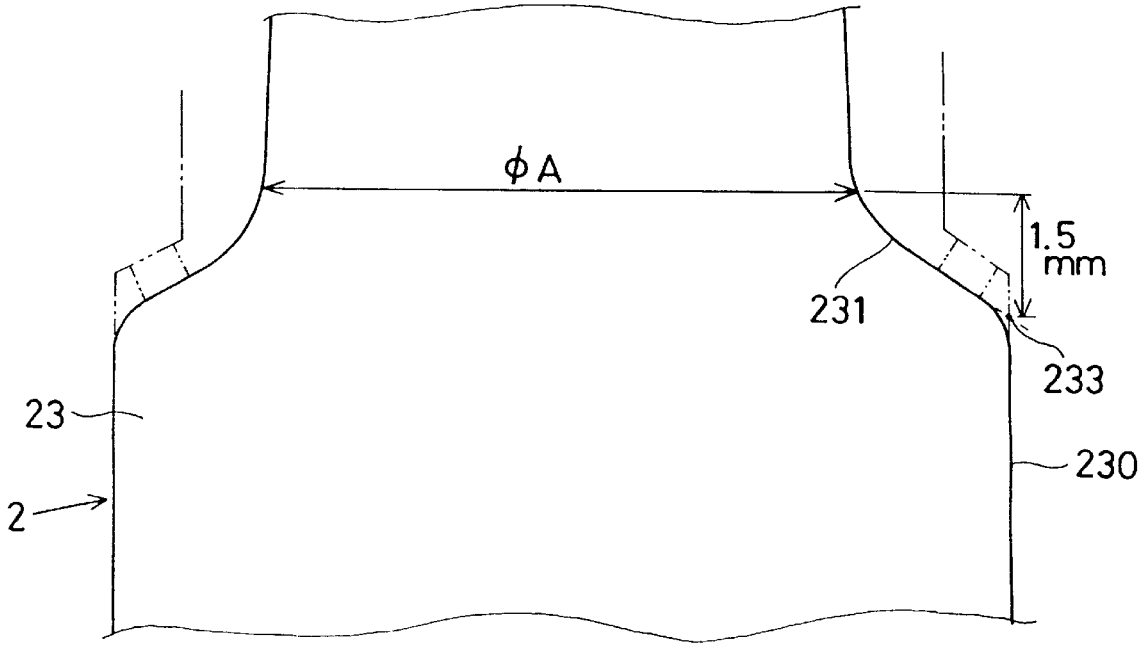
FIG. 16 is an explanatory view how to determine a basal diameter (A) of a basal portion of an insulator nose.

Upon determining the basal diameter (A), as schematically shown in FIG. 16, a first extention line of a barrel portion 230 of the insulator nose 23 and a second extension line of the shoulder portion 231 are defined respectively. Then, the basal diameter (A) is measured at a level which is axially forward by 1.5 mm from an intersection 233 of the first and second extension lines.

The center electrode 3 has a nickel-based alloy (Ni, Si, Mn, Cr-based alloy or NCF600) in which a heat-conductor copper core is embedded to form a composite structure as a whole. When the center electrode 3 is placed within the axial bore 22, a front end surface 31 of the center electrode 3 extends beyond a front end surface 21 of the insulator 2.

The ground electrode 4 is made of a nickel-based alloy (e.g., NFC600) and bent into L-shaped configuration so that its front end surface 41 opposes an outer surface 311 of the center electrode 3 to form the air gap (G) and a creeping discharge gap (Go) contiguously therebetween. The air gap (G) provided between the front end surface 41 of the ground electrode 4 and an outer surface 25 of the insulator 2 measures e.g., 0.5 mm. Upon applying a high voltage across the electrodes 3, 4, the spark discharges runs through the air gap (G) and a creeping discharge gap (Go) to introduce the spark discharges along the front end surface 21 of the insulator 2.

Figure 3:
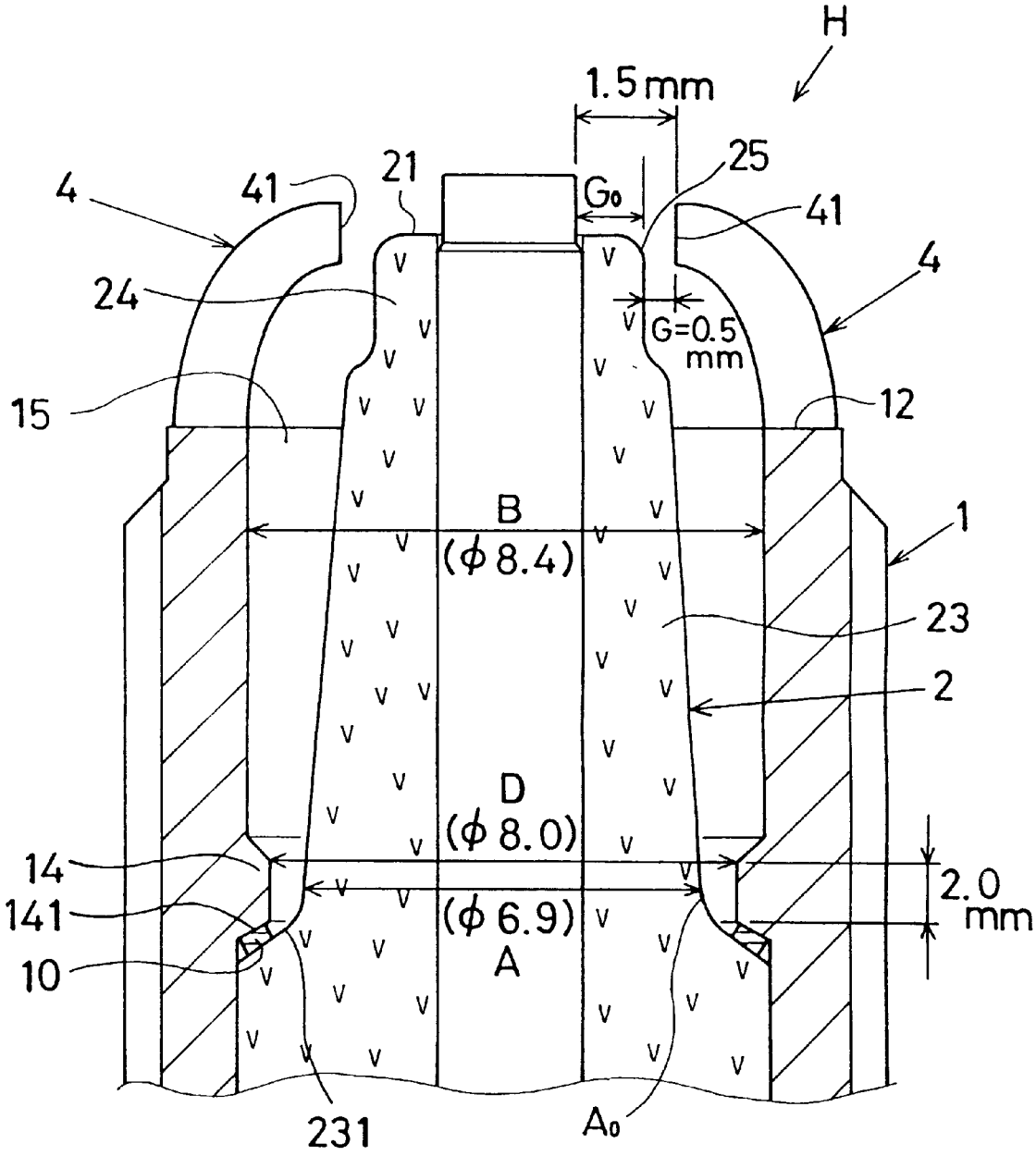
FIG. 3 is a longitudinal cross sectional view of a front portion of a counterpart semi-creeping discharge type spark plug (H) shown for the purpose of comparison.

FIG. 3 shows a counterpart semi-creeping type spark plug (H) provided for the purpose of comparison. The spark plug (H) is structurally identical to the semi-creeping type spark plug (P) except that the spark plug (H) has a ledge portion 14. The ledge portion 14 is provided on an inner wall of the metal shell 1 in a fashion to project inward along the diametrical direction. The insulator 2 rests its shoulder portion 231 via the packing 10 on a rear taper section 141 which is formed at a rear edge section of the ledge portion 14.

In this instance, the insulator nose 23 measures 6.9 mm in basal diameter (A) and 14.0 mm in length while the ledge portion 14 measures 8.0 mm in diameter (D) and 2.0 mm in length.

In the comparative semi-creeping type spark plug (H), an inner diameter (B) of the metal shell 1 which lies foward from the ledge portion 14 is 8.4 mm. The air gap (G) measures 0.5 mm which is provided between the front end surface 41 of the ground electrode 4 and the outer surface 25 of the insulator 2.

A soot fouling resistance experimental test was carried out with the spark plugs (P), (H) mounted respectively on a test automobile in conformity with the predelivery pattern (paragraph 5.2 (1) JIS-D1606). During the experimental test, the test automobile was placed on a chassis dynamotor in a cold experimental room (−10° C.). The experimental test results are shown respectively by FIGS. 2 and 4 in the context of the graphical representation between an insulation resistance (M Ω) and the number of cycles (N).

Upon considering the advantages of the spark plugs (P) over the comparative spark plug (H), the spark plug (P) is such that the inner wall of the metal shell 1 has a diameter-decreased section (8.0 mm in diameter (B)) provided at the front area forward from the seat portion 11 which is diametrically smaller than the diameterincreased section (9.2 mm in diameter) provided at a rear area backward from the seat portion 11. In the spark plug (P), it was found that no substantial problem arises without forming the ledge portion 14 at the inner wall of the metal shell 1 when placing the insulator 2 in the metal shell 1 because the metal shell 1 is diametrically greater as evidenced by the male threaded portion 13 in terms of (M14).

Because of the relatively small diameter (B) of the inner wall of the metal shell 1, a front open end area 15 of the metal shell 1 remains comparatively small. This makes it possible to prevent an entry of carbon deposit through the front open end area 15 of the metal shell 1, which would othewise settle on an outer surface 232 of the insulator nose 23.

Under the absence of the ledge portion 14 which projects inward within the metal shell 1, it is possible to effectively prevent the flashover from penetrating deep into the metal shell 1 when the insulator 2 is carbon fouled to an unacceptable degree.

Figure 4:
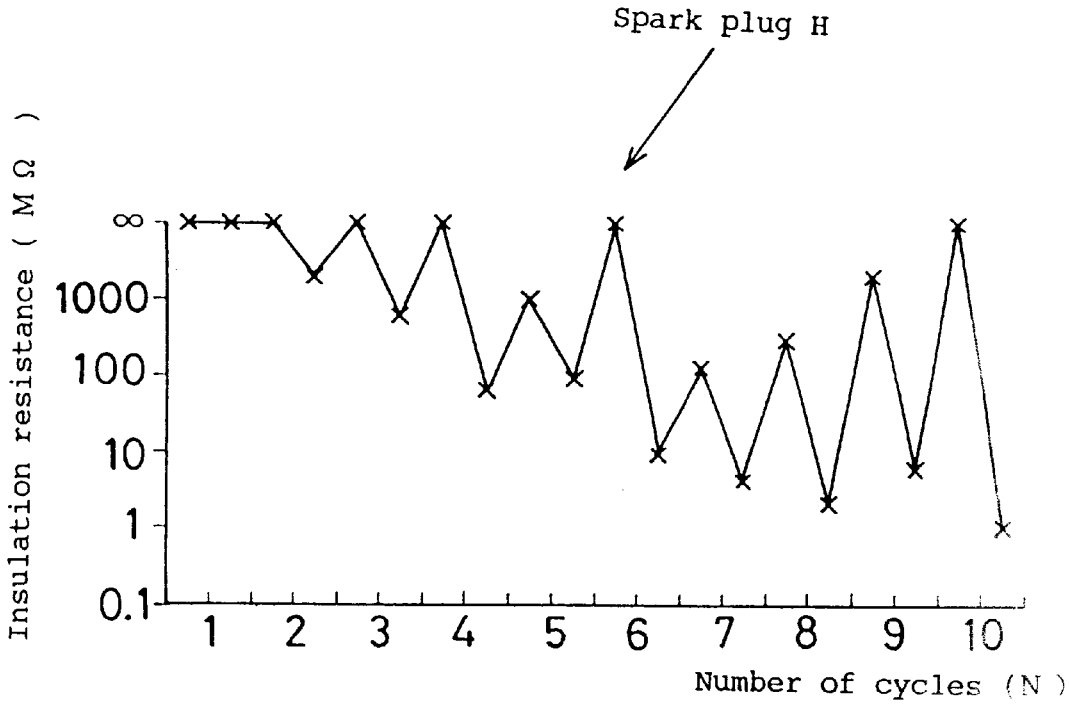
FIG. 4 is a graphical representation showing a relationship between an insulation resistance and the number of cycles in accordance with the semi-creeping discharge type spark plug (H)

With the flashover thus effectively prevented in the semi-creeping discharge type spark plug (P), it is possible to facilitate the self-cleaning action so as to maintain a high insulation resistance value as understood by comparing the graphical representation in FIG. 2 and FIG. 4. This substantially eliminates the inconveniences such as, for example, the engine stall, unstable idling, loss of cold starting capability and insufficient accelaration of the engine.

FIGS. 5 through 8 show a second embodiment of the invention in which an intermittent creeping type spark plug (Q) is provided which is structurally identical to the semi-creeping discharge type spark plug (P) except that the front end of the ground electrode 4 is partly overlapped with the front end surface 21 of the insulator 2. The spark plug (Q) forms the spark discharge gap (Go=1.0 mm) between the front end surface 41 of the ground electrode 4 and the outer surface 311 of the center electrode 3 in order to effectuate the aerial spark discharges and intermittent creeping spark discharges therebetween. At the time when the insulator 2 is carbon fouled unacceptably, the ground electrode 4 releases the creeping spark discharges intermittently along the front end surface 21 of the insulator 2 across the air gap (G=0.5 mm) between a front edge portion 42 of the ground electrode 4 and the front end surface 21 of the insulator 2.

In the intermittent creeping type spark plug (Q), the inner wall of the metal shell 1 measures 8.0 mm in diameter (B), and the insulator nose 23 measures 6.9 mm in basal diameter (A).

Figure 7:
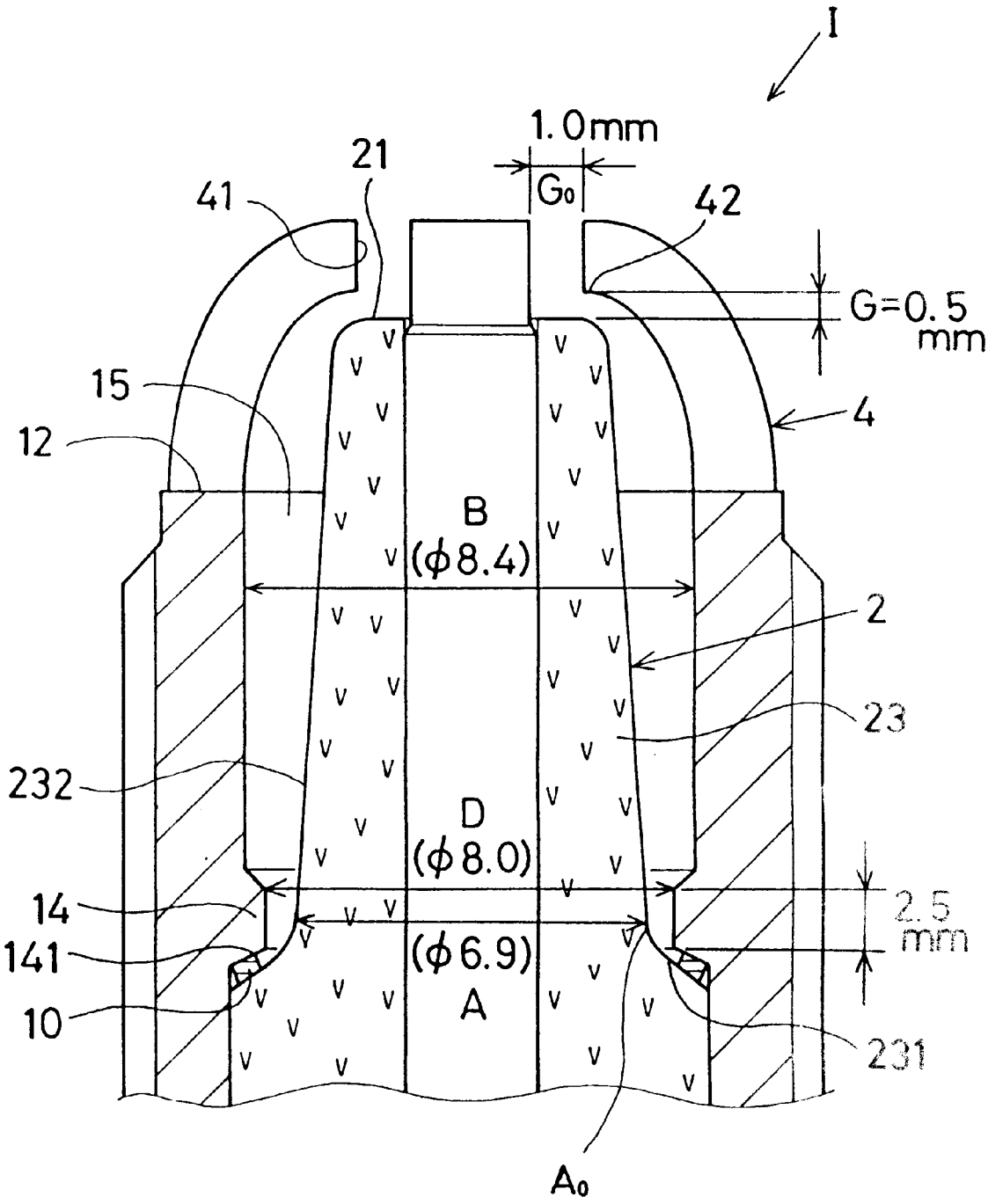
FIG. 7 is a longitudinal cross sectional view of a front portion of a counterpart intermittent creeping discharge type spark plug (I) shown for the purpose of comparison.

FIG. 7 shows a counterpart intermittent creeping type spark plug (I) provided for the purpose of comparison. The spark plug (I) is structurally identical to the semi-creeping type spark plug (Q) except that the spark plug (I) has the ledge portion 14. The insulator 2 rests its shoulder portion 231 via the packing 10 on the rear taper section 141 of the ledge portion 14.

In the counterpart intermittent creeping type spark plug (I), the insulator nose 23 measures 6.9 mm in basal diameter (A) and 14.0 mm in length while the ledge portion 14 measures 8.0 mm in diameter (D) and 2.5 mm in length. The air gap (G) measures 0.5 mm which is the same as the air gap provided in the intermittent creeping type spark plug (Q).

In the same manner as described in the first embodiment of the invention, the soot fouling resistance experimental test was carried out with the spark plugs (Q), (I) mounted respectively on the test automobile in conformity with the predelivery pattern (paragraph 5.2 (1) JIS-D1606).

Figure 6:
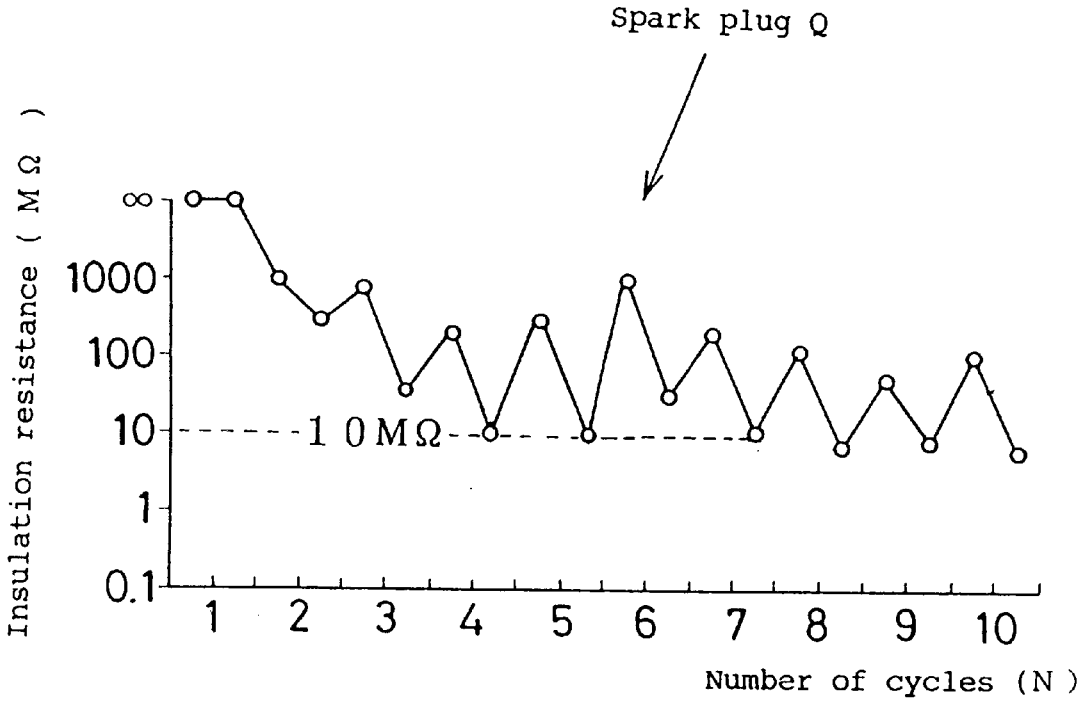
FIG. 6 is a graphical representation showing a relationship between an insulation resistance and the number of cycles in accordance with the intermittent creeping discharge type spark plug (Q)
Figure 8:
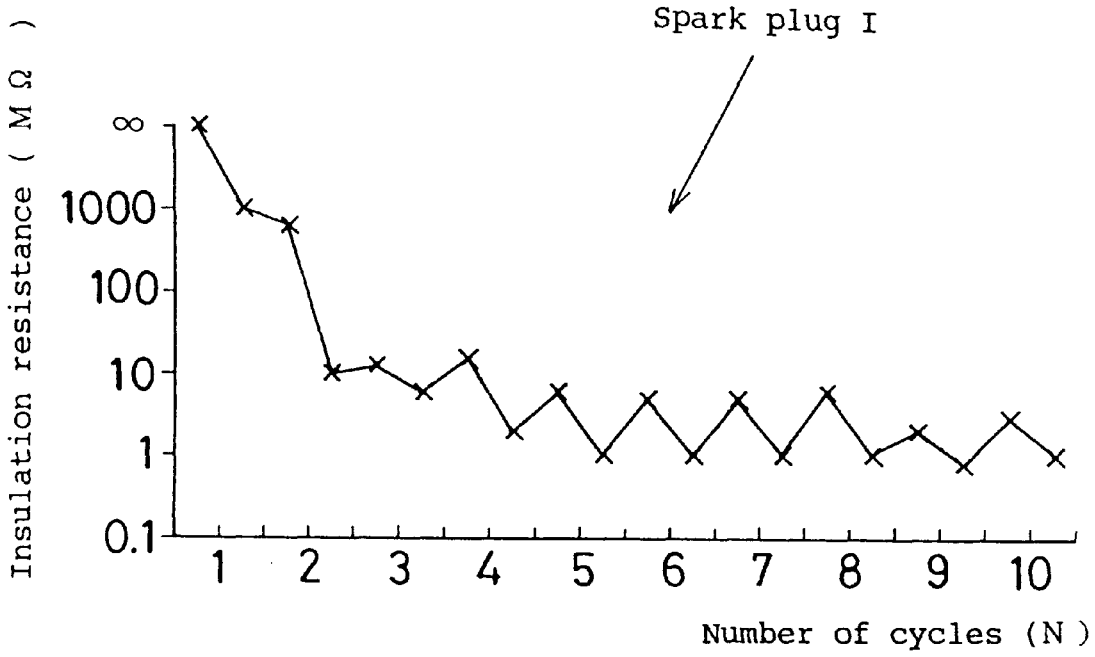
FIG. 8 is a graphical representation showing a relationship between an insulation resistance and the number of cycles in accordance with the intermittent creeping discharge type spark plug (I)

The experimental test results are shown respectively in FIGS. 6 and 8 in the context of the graphical representation between an insulation resistance (M Ω) and the number of cycles (N).

With the relatively small diameter (B) of the inner wall of the metal shell 1, it is possible to remain the front open end area 15 of the metal shell 1 comparatively small. This makes it possible to prevent an entry of carbon deposit through the front open end area 15 of the metal shell 1, which would otherwise settle on the outer surface 232 of the insulator nose 23.

Devoid of the ledge portion 14 which projects inward, it is possible to effectively prevent the flashover from penetrating deep through the front end surface 12 of the metah shell 1 when the insulator 2 is carbon fouled unacceptably.

With the flashover thus effectively prevented in the intermittent creeping discharge type spark plug (Q), it is possible to facilitate the self-cleaning action so as to maintain a high insulation resistance value as understood by comparing the graphical representation in FIG. 6 and FIG. 8. This makes it possible to dispense with the inconveniences such as the engine stall, unstable idling, loss of cold starting capability and insufficient acceleration of the engine or the like.

Figure 9:
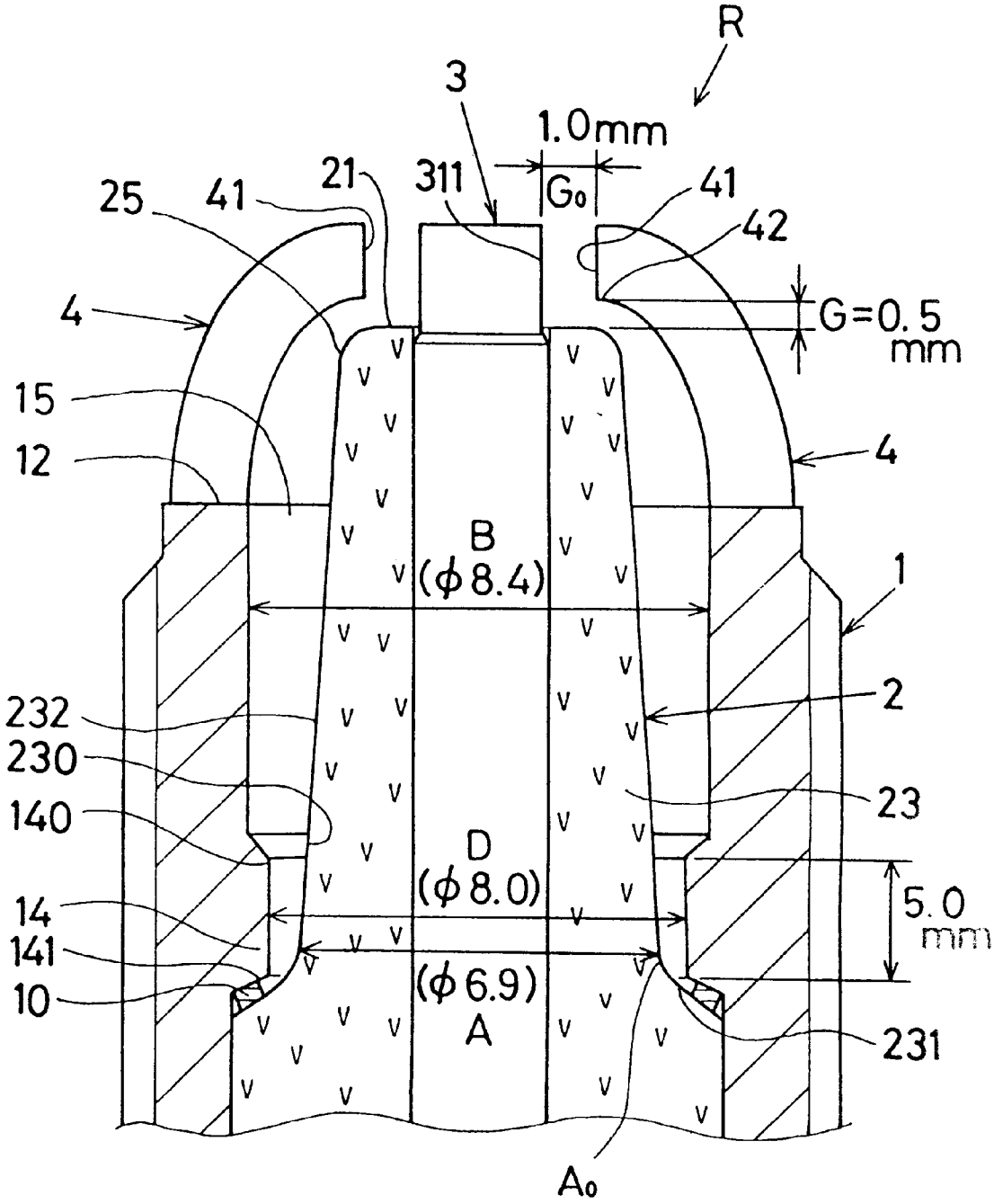
FIG. 9 is a longitudinal cross sectional view of a front portion of an intermittent creeping discharge type spark plug (R) according to a third embodiment of the invention.
Figure 10:
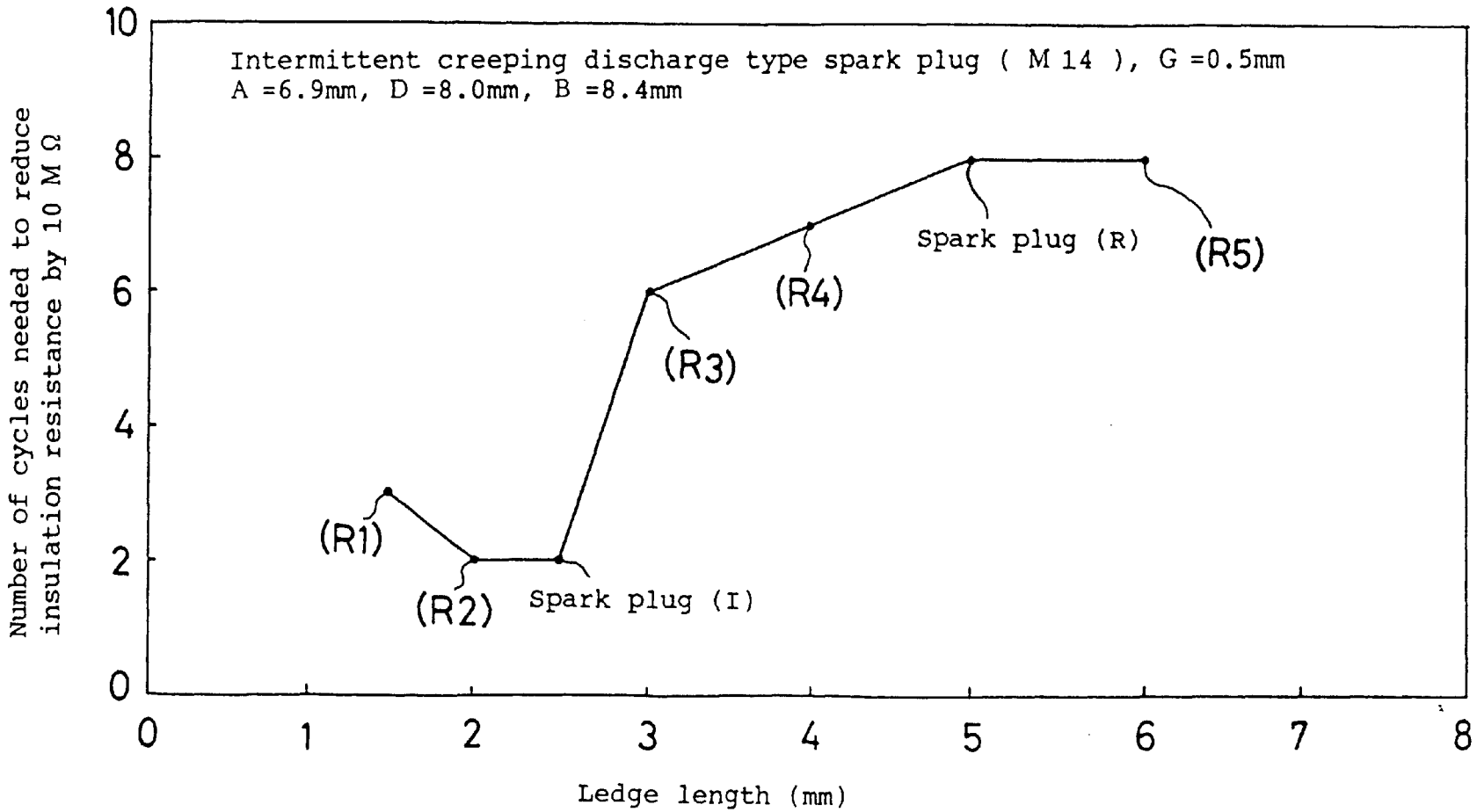
FIG. 10 is a graphical representation showing a relationship between a ledge length and the number of cycles needed to reduce an insulation resistance by 10 M Ω mainly in accordance with an intermittent creeping discharge type spark plug (R)

FIGS. 9 and 10 show a third embodiment of the invention in which an intermittent creeping discharge type spark plug (R) is provided. The spark plug (R) has the ledge portion 14 which measures 8.0 mm in diameter (D) and 5.0 mm in length while the inner diameter (B) of the metal shell 1 measures 8.4 mm and the basal diameter (A) of the insulator nose 23 measures 6.9 mm. The sizes of the spark discharge gap (Go) and the air gap (G) are the same as those of the intermittent creeping discharge type spark plug (Q) according to the second embodiment of the invention.

In addition to the intermittent creeping discharge type spark plugs (I), (R), the same type of spark plugs (R1)~(R5) are prepared in which the length of the ledge portions 14 measures in turn 1.5 mm, 2.0 mm, 3.0 mm, 4.0 mm and 6.0 mm. The spark plugs (I), (R) and (R1)~(R5) were mounted in turn on the test automobile to carry out the soot fouling resistance experimental test in the same manner as described in the first embodiment of the invention.

The experimental test results are shown by FIG. 10 in the context of the graphical representation between the length of the ledge portion 14 and the number of cycles (N) needed to reduce the insulation resistance by 10 MΩ.

In the intermittent creeping discharge type spark plug (R) including (R2)~(R5), the length of the lege portion 14 is such as to insure a sufficient clearance at the basal portion (Ao) between a forward edge 140 of the ledge portion 14 and the barrel portion 230 of the insulator 2. This prevents the flashover from inadvertently penetrating deep through the front open end area 15 of the metal shell 1. In order to avoid the flashover, it is preferable to determine the ledge length to be 3.0 mm or more.

In this instance, it is confirmed that the same advantages were achieved as those attained by the first embodiment of the invention.

It is to be observed that when determining the ledge length to be 3.0 mm or more in the semi-creeping discharge type spark plug (H) of FIG. 3, it is possible to substantially insure the same advantages as those attained by the the intermittent creeping discharge type spark plug (R).

Figure 11:
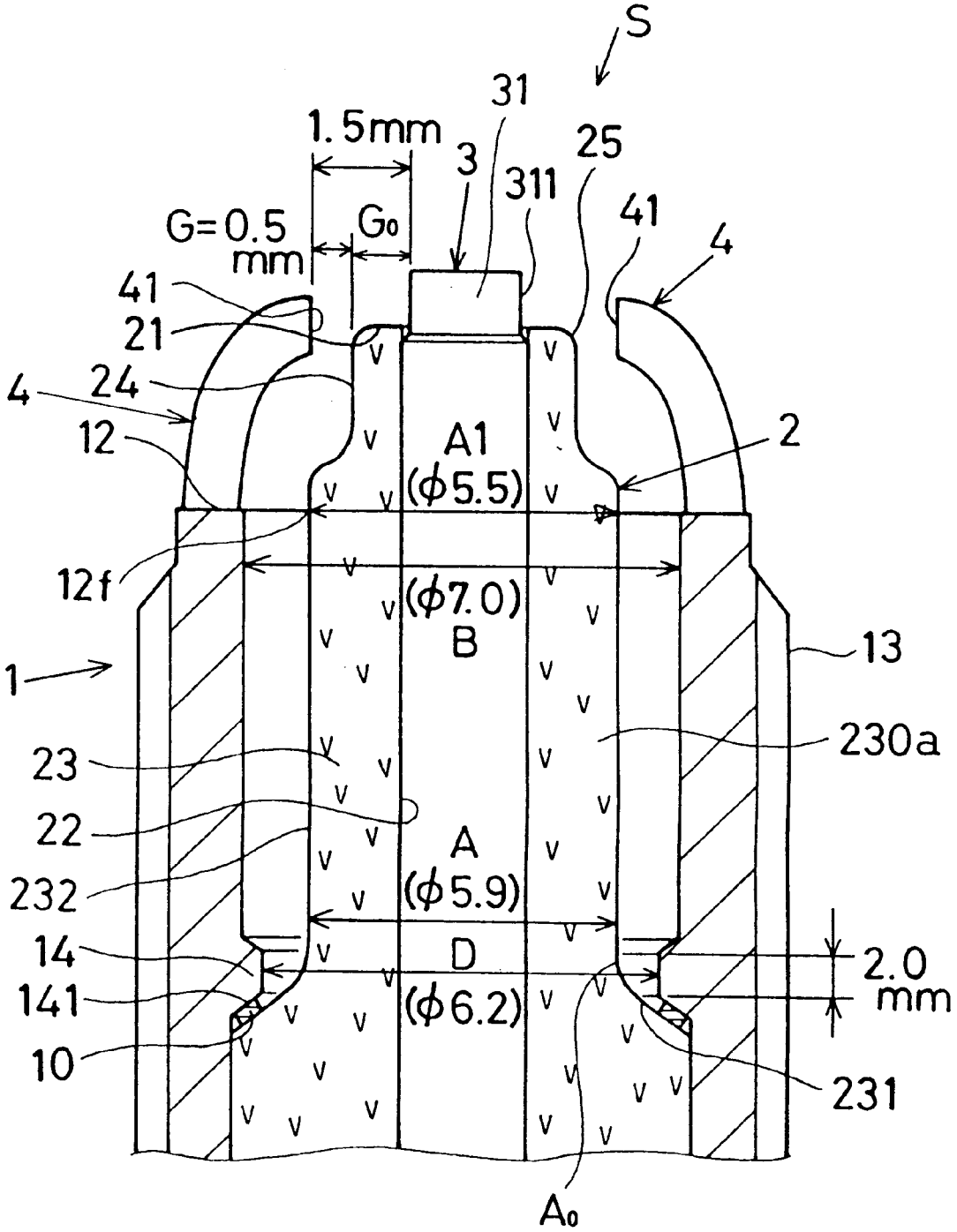
FIG. 11 is a longitudinal cross sectional view of a front portion of a semi-creeping discharge type spark plug (S) according to a fourth embodiment of the invention.
Figure 12:
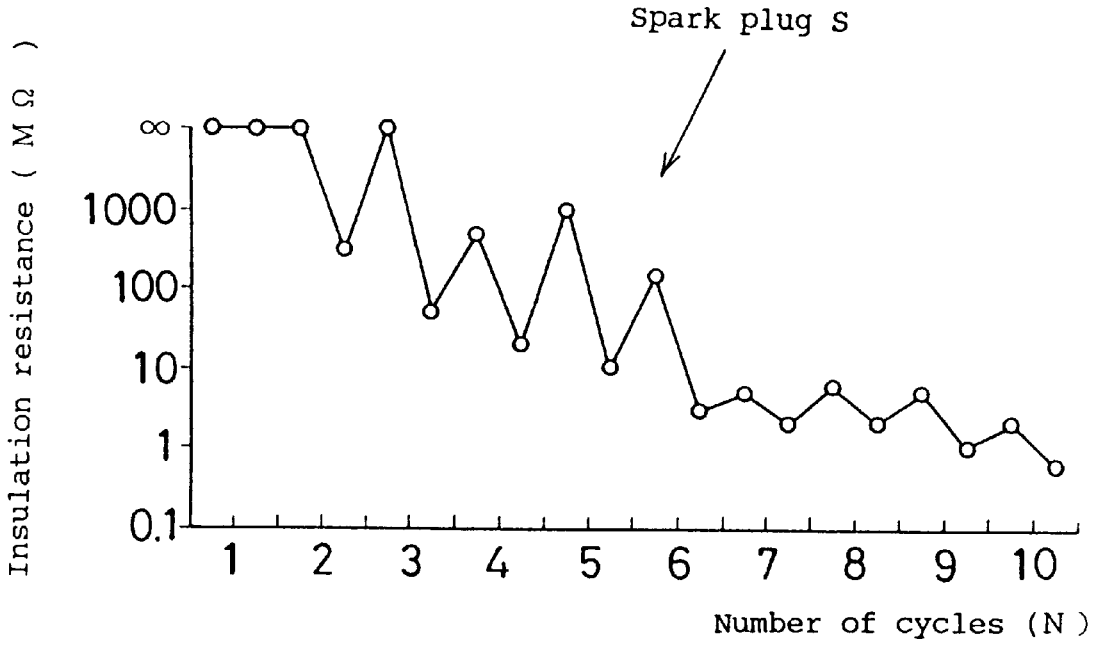
FIG. 12 is a graphical representation showing a relationship between an insulation resistance and the number of cycles in accordance with the semi-creeping discharge type spark plug (S)

FIGS. 11 and 12 show a fourth embodiment of the invention in which a semi-creeping discharge type spark plug (S) is provided which is generally identical to the semi-creeping discharge type spark plug (H) of FIG. 3 except for the following particulars.

In the spark plug (S) according to the fourth embodiment of the invention, the male threaded portion 13 is formed in terms of M12 which is smaller than the size of M 14. This may account for the presence of the ledge portion 14 provided on the inner wall of the metal shell 1. The inner diameter (B) of the metal shell 1 is 7.0 mm and the inner diameter (D) of the ledge portion 14 is 6.2 mm. The insulator 2 measures 5.9 mm in basal diameter (A) and 14.0 mm in length.

The insulator nose 23 has a tubular section 230*a*, the tapered shoulder portion 231 and the straight neck portion 24 which extends beyond the front end surface 12 of the metal shell 1.

In this instance, the insulator nose 23 has a forward edge 12*f* of the tubular section 230*a* which corresponds to the front end surface 12 of the metal shell 1. The dimensional difference between the basal diameter (A) and the diameter (A1) of the forward edge 12*f* is predetermined to be 0.5 mm or less.

Figure 13:
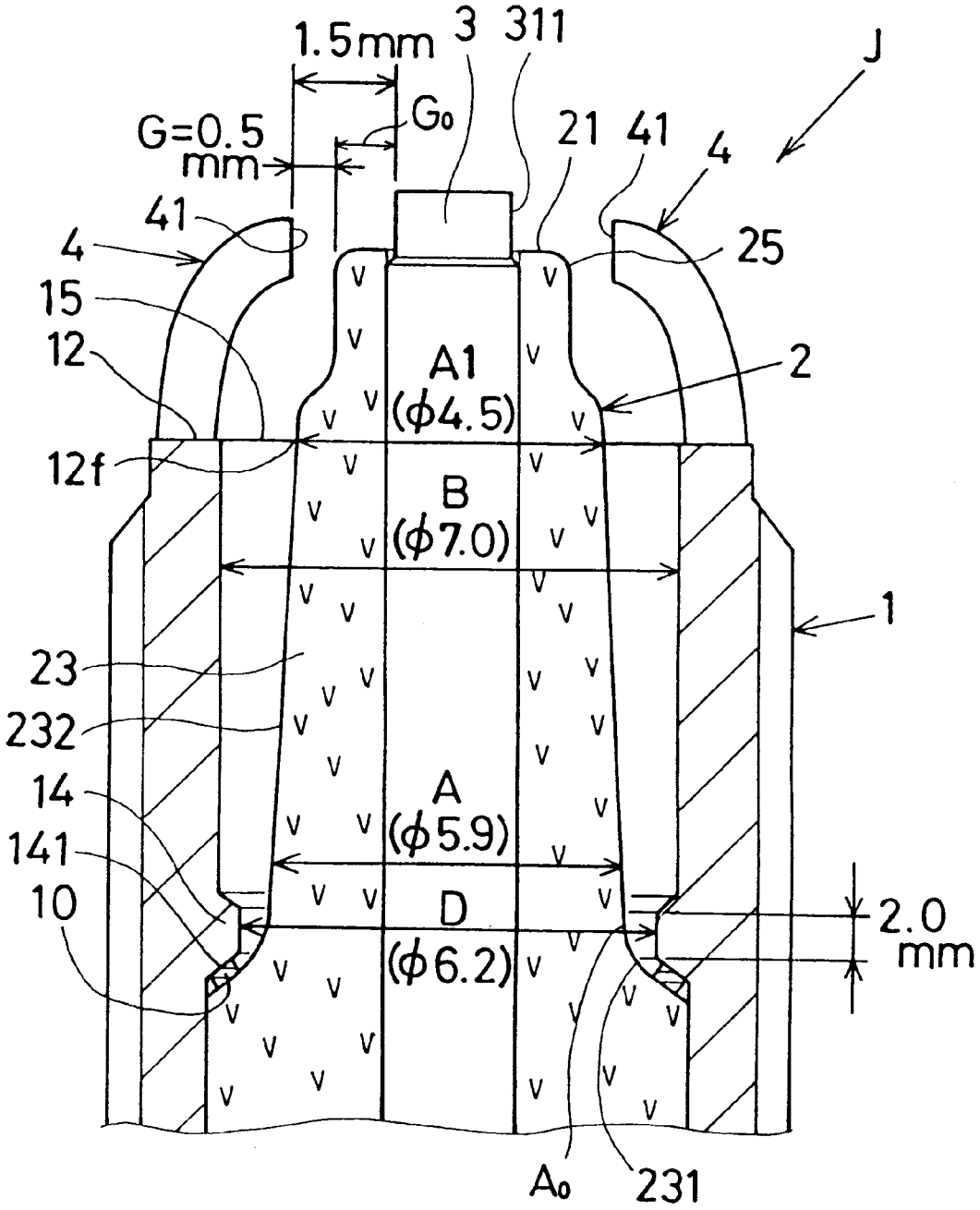
FIG. 13 is a longitudinal cross sectional view of a front portion of a counterpart semi-creeping discharge type spark plug (J) shown for the purpose of comparison.

FIG. 13 shows a counterpart semi-creeping type spark plug (J) provided for the purpose of comparison. The spark plug (J) is structurally identical to the semi-creeping type spark plug (S) except for the following particulars.

On the premise that the insulator 2 measures 5.9 mm in basal diameter (A) and 14.0 mm in length, the dimensional difference between the basal diameter (A=5.9 mm) and the diameter (A1=4.5 mm) of the forward edge 12*f* is predetermined to exceed 0.5 mm.

The soot fouling resistance experimental test was carried out with the spark plugs (S), (J) in turn mounted on the test automobile in the same manner as described in the first embodiment of the invention.

Figure 14:
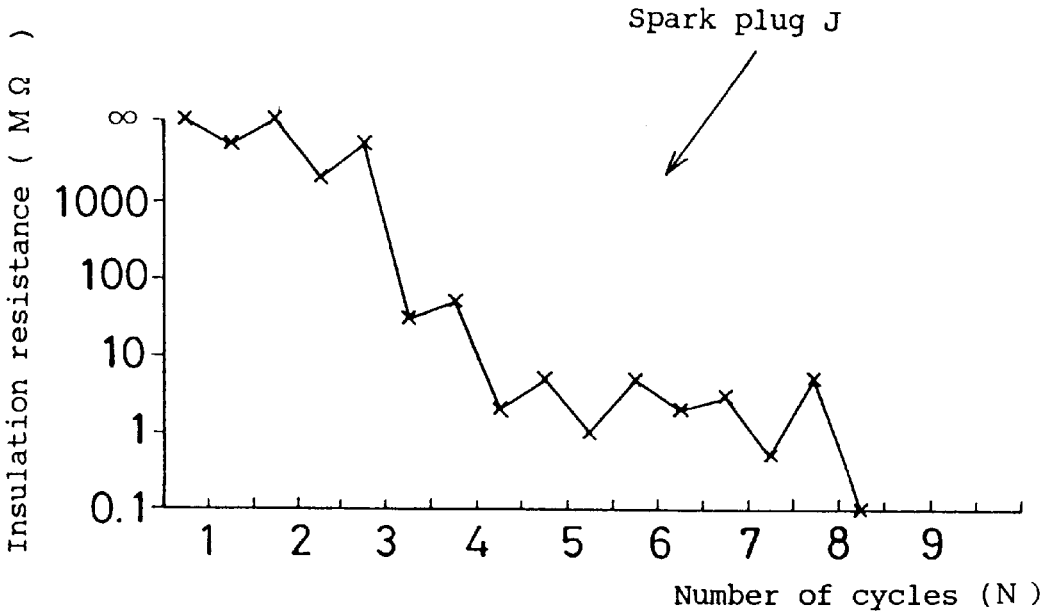
FIG. 14 is a graphical representation showing a relationship between an insulation resistance and the number of cycles in accordance with the semi-creeping discharge type spark plug (J)

The experimental test results are shown respectively in FIGS. 12 and 14 in the context of the graphical representation between the insulation resistance and the number of cycles (N).

With the dimensional difference between the basal diameter (A) and the diameter (A1) of the forward edge 12*f* predetermined to be 0.5 mm or less, it is possible to insure a sufficient clearance (insulation space) between the inner wall of the metal shell 1 and the outer surface 232 of the basal portion (Ao) of the insulator nose 23.

This effectively prevents the flashover from penetrating deep into the metal shell 1 when the insulator 2 is carbon foulded to an unacceptable degree.

With the flashover thus effectively prevented, the semi-creeping discharge type spark plug (S), it is possible to facilitate the self-cleaning action so as to maintain a high insulation resistance value as understood by comparing the graphical representation in FIG. 12 and FIG. 14. In the semi-creeping discharge type spark plug (S), the same advantages are obtained as those achieved by the first embodiment of the invention.

It is confirmed that a good fouling resistant property was obtained in the same extent as represented by FIG. 12 when the intermittent creeping discharge type spark plug satisfies the requirement that the dimensional difference between the basal diameter (A=5.9 mm) and the diameter (A1=5.5 mm) of the forward edge 12*f* is to be 0.5 mm or less.

Figure 5:
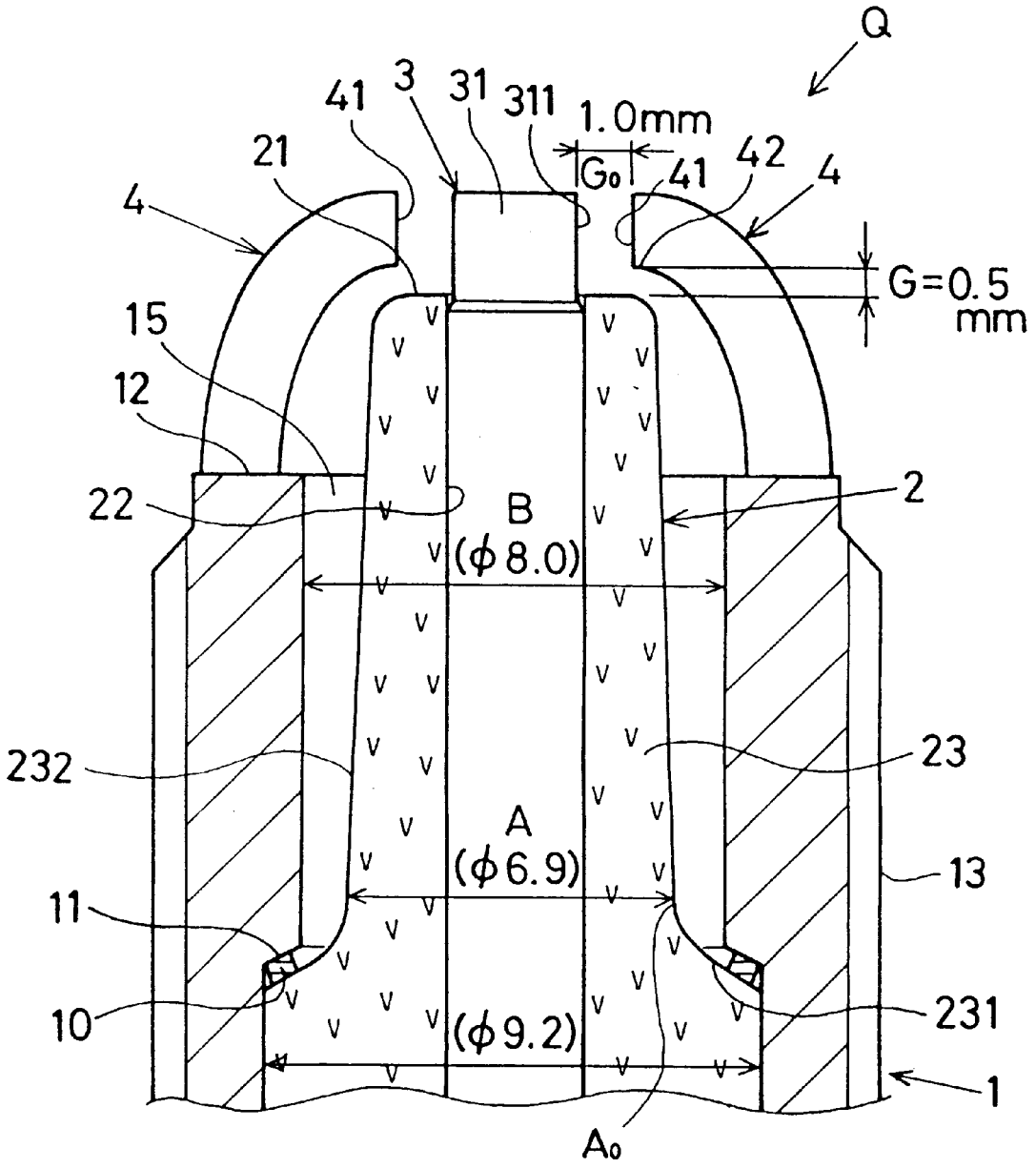
FIG. 5 is a longitudinal cross sectional view of a front portion of an intermittent creeping discharge type spark plug (Q) according to a second embodiment of the invention.

In a fifth embodiment of the invention in which the basal diameter (A) is variously altered to search how the soot fouling resistant property changes depending on a formula (B−A)/2 in the intermittent creeping discharge type spark plug (Q) represented by FIG. 5. The formula (B−A)/2 means a clearance between the inner wall of the metal shell 1 and the basal portion (Ao) of the insulator nose 23. The fouling resistant property was estimated by the number of cycles needed to reduce the insulation resistance by 10 MΩ in conformity with the soot fouling Do experimental test stipulated by JIS D 1606.

Upon carrying out the experimental test, specimens (Q1)~(Q6) of the intermittent creeping discharge type spark plug were used, the basal diameter (A) of which is in turn 7.2 mm, 7.0 mm, 6.8 mm, 6.6 mm. 6.4 mm and 6.2 mm with the spark discharge gap and air gap (G) unified as 1.0 mm and 0.5 mm respectively.

Figure 15:
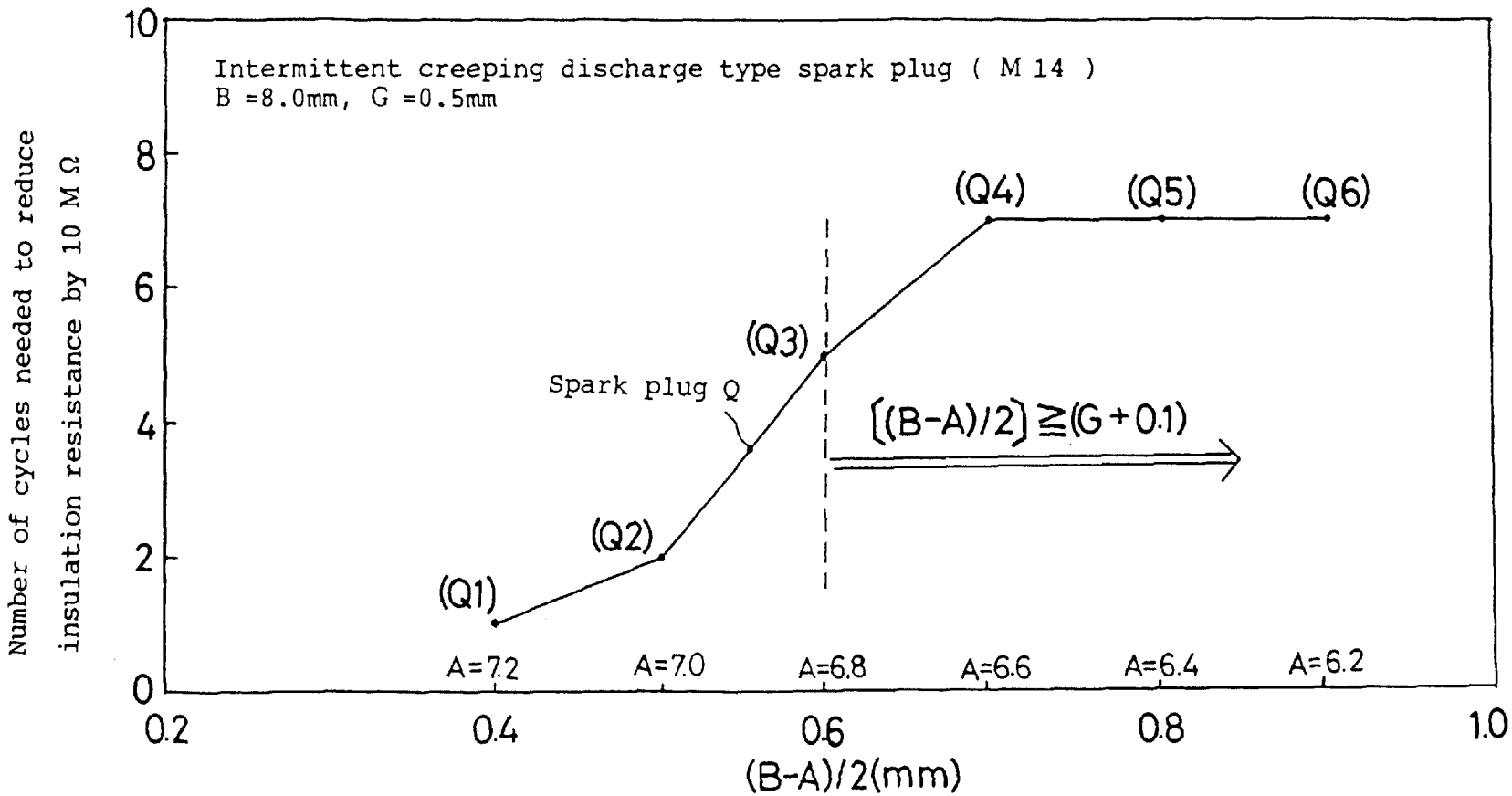
FIG. 15 is a graphical representation showing a relationship between a formula $\{(A-B)/2\} \geqq (G+0.1)$ and the number of cycles needed to reduce an insulation resistance by 10 M Ω mainly in accordance with the intermittent creeping discharge type spark plug (Q)

As shown in FIG. 15, it is possible to attain a good fouling resistance when the clearance (B−A)/2 is 0.6 mm, 0.7 mm, 0.8 mm and 0.9 mm respectively as represented by the specimens (Q3)~(Q6). This means that insomuch as the relationship (B−A)/2≧(G+0.1) is satisfied, it is possible to effectively prevents the flashover from penetrating deep into the metal shell 1 when the insulator 2 is carbon foulded unacceptably.

It is confirmed that the relationship (B−A)/2≧(G+0.1) can be applied as well to the semi-creeping discharge type spark plugs (P), (S) and the intermittent creeping discharge type spark plug (R) which are represented respectively by FIGS. 1, 11 and 9.

Upon applying the relationship (B−A)/2≧(G+0.1) so as to reduce the soot fouling phenomenon, it was found that the relationship (B−A)/2≧(G+0.1) works more effectively when applying to the intermittent creeping discharge type spark plug than when applying to the semi-creeping discharge type spark plug.

It is to be noted that the number of the ground electrodes 4 is not limited to two, and three or more ground electrode may be arranged at regular intervals around the front end surface 12 of the metal shell 1. In this instance, the ground electrodes 4 may be made in integral with the metal shell 1.

It is also to be noted that the dimensional size of the insulator 2 determined herein is only by way of example, and it stands as a matter of course that the size of the insulator 2 may be altered as desired.

What is claimed is:

1. A semi-creeping discharge type spark plug comprising:

a cylindrical metal shell, an inner wall of which has a rear section and a front section to respectively serve as a diameter-increased section and a diameter-decreased section with a seat portion as a boundary therebetween;

an insulator fixedly placed within said metal shell so that a front end surface of said insulator extends beyond a front end surface of said metal shell with a shoulder portion of an insulator nose engaged against said seat portion of said metal shell by way of a packing;

a center electrode fixedly placed within an axial bore of said insulator;

a ground electrode connected to said front end surface of said metal shell, and bent so that a front end surface of said ground electrode opposes an outer surface of said center electrode; and said outer surface and a front end surface of said center electrode provided to respectively serve as a firing portion so as to form a spark discharge gap with said front end surface of said ground electrode, said front end surface of said ground electrode forming an air gap with an outer surface of said insulator so as to release creeping spark discharges along a front end surface of said insulator.

2. A spark plug according to claim 1, wherein a geometrical relationship among A, B, and G is defined as follows:

$$\{(A-B)/2\}\text{mm} \geqq (G+0.1)\text{mm}.$$

Where A is a diameter of a basal portion of said insulator nose,

B is an inner diameter a front portion of said metal shell,

G is the air gap between said front end surface of said ground electrode and said outer surface of said insulator.

3. An intermittent creeping discharge type spark plug comprising:

a cylindrical metal shell, an inner wall of which has a rear section and a front section to respectively serve as a diameter-increased section and a diameter-decreased section with a seat portion as a boundary therebetween;

an insulator fixedly placed within said metal shell so that a front end surface of said insulator extends beyond a front end surface of said metal shell with a shoulder portion of an insulator nose engaged against said seat portion of said metal shell by way of a packing;

a center electrode fixedly placed within an axial bore of said insulator so that a front end surface of said center electrode extends beyond a front end surface of said insulator;

a ground electrode connected to said front end surface of said-metal shell, and bent so that a front end surface of said ground electrode opposes an outer surface of said center electrode; and said outer surface of said center electrode provided to serve as a firing portion so as to form a spark discharge gap with said front end surface of said ground electrode, creeping spark discharges being released from a front edge of said ground electrode toward said front end surface of said insulator so as to facilitate a self-cleaning action when said insulator is carbon fouled.

4. A spark plug according to claim 3, wherein a geometrical relationship among A, B, and G is defined as follows:

$$\{(A-B)/2\}\text{mm} \geqq (G+0.1)\text{mm}.$$

Where A is a diameter of a basal portion of said insulator nose,

B is an inner diameter a front portion of said metal shell,

G is the air gap between said front end surface of said ground electrode and said outer surface of said insulator.

5. A semi-creeping discharge type spark plug comprising:

a cylindrical metal shell, an inner wall of which has a seat portion;

an insulator fixedly placed within said metal shell so that a front end surface of said insulator extends beyond a front end surface of said metal shell with a shoulder portion of an insulator nose engaged against said seat portion of said metal shell by way of a packing;

a center electrode fixedly placed within an axial bore of said insulator;

a ground electrode connected to said front end surface of said metal shell, and bent so that a front end surface of said ground electrode opposes an outer surface of said center electrode;

said outer surface and a front end surface of said center electrode provided to respectively serve as a firing portion so as to form a spark discharge gap with said front end surface of said ground electrode, said front end surface of-said ground electrode forming an air gap with an outer surface of said insulator so as to release creeping spark discharges along a front end surface of said insulator; and said insulator being formed so that a diametrical difference is to be 0.5 mm or less between a basal portion of said insulator nose and a forward end of said insulator nose, the latter of which corresponds to said front end surface of said metal shell.

6. A spark plug according to claim 5, wherein a geometrical relationship among A, B, and G is defined as follows:

$$\{(A-B)/2\}\text{mm} \geqq (G+0.1)\text{mm}.$$

Where A is a diameter of said basal portion of said insulator nose,

B is an inner diameter a front portion of said metal shell,

G is the air gap between said front end surface of said ground electrode and said outer surface of said insulator.

7. An intermittent creeping discharge type spark plug comprising:

a cylindrical metal shell, an inner wall of which has a seat portion;

an insulator fixedly placed within said metal shell so that a front end surface of said insulator extends beyond a front end surface of said metal shell with a shoulder portion of an insulator nose engaged against said seat portion of said metal shell by way of a packing;

a center electrode fixedly placed within an axial bore of said insulator so that a front end surface of said center electrode extends beyond a front end surface of said insulator;

a ground electrode connected to said front end surface of said metal shell, and bent so that a front end surface of said ground electrode opposes an outer surface of said center electrode;

said outer surface of said center electrode provided to serve as a firing portion so as to form a spark discharge gap with said front end surface of said ground electrode, creeping spark discharges being released from a front edge of said ground electrode toward said front end surface of said insulator so as to facilitate a self-cleaning action when said insulator is carbon fouled; and said insulator being formed so that a diametrical difference is 0.5 mm or less between a basal portion of said insulator nose and a forward end of said insulator nose, the latter of which corresponds to said front end surface of said metal shell.

8. A spark plug according to claim 7, wherein a geometrical relationship among A, B, and G is defined as follows:

$$\{(A-B)/2\}\text{mm} \geqq (G+0.1)\text{mm}.$$

Where A is a diameter of said basal portion of said insulator nose,

B is an inner diameter a front portion of said metal shell,

G is the air gap between said front end surface of said ground electrode and said outer surface of said insulator.

9. A semi-creeping discharge type spark plug comprising:

a cylindrical metal shell, an inner wall of which has a ledge portion projected in the diametrical direction;

an insulator fixedly placed within said metal shell so that a front end surface of said insulator extends beyond a front end surface of said metal shell with a shoulder portion of an insulator nose engaged by way of a packing against a seat portion provided with an upper surface of said ledge portion of said metal shell;

a center electrode fixedly placed within an axial bore of said insulator;

a ground electrode connected to said front end surface of said metal shell, and bent so that a front end surface of said ground electrode opposes an outer surface of said center electrode;

a firing end of said center electrode provided to form a spark discharge gap with said front end surface of said ground electrode, said front end surface of said ground electrode forming an air gap with an outer surface of said insulator so as to release creeping spark discharges along a front end surface of said insulator, or otherwise releasing the spark discharges from a front edge of said ground electrode toward said front end surface of said insulator so as to facilitate a self-cleaning action when said insulator is carbon fouled; and a ledge length of said ledge portion being 3.0 mm or more.

10. A spark plug according to claim 9, wherein a geometrical relationship among A, B, and G is defined as follows:

$$\{(A-B)/2\}\text{mm} \geqq (G+0.1)\text{mm}.$$

Where A is a diameter of a basal portion of said insulator nose,

B is an inner diameter a front portion of said metal shell,

G is the air gap between said front end surface of said ground electrode and said outer surface of said insulator.

* * * * *